US008421572B2

(12) United States Patent
Cheng et al.

(10) Patent No.: US 8,421,572 B2
(45) Date of Patent: Apr. 16, 2013

(54) BOBBIN AND TRANSFORMER COMPRISING THE SAME

(75) Inventors: I-Chi Cheng, Taoyuan Hsien (TW); Yi-Fan Wu, Taoyuan Hsien (TW); Cheng-Yi Lo, Taoyuan Hsien (TW); Ming-Cheng Lee, Taoyuan Hsien (TW); Kuo-Jung Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/267,884

(22) Filed: Oct. 7, 2011

(65) Prior Publication Data

US 2012/0280780 A1 Nov. 8, 2012

(30) Foreign Application Priority Data

May 6, 2011 (TW) ..... 100115877 A

(51) Int. Cl.
*H01F 27/30* (2006.01)
*H01F 27/29* (2006.01)
*H01F 17/04* (2006.01)

(52) U.S. Cl.
USPC ..... 336/198; 336/192; 336/221

(58) Field of Classification Search ..... 336/65, 336/98, 192, 196, 198, 221, 232
See application file for complete search history.

(56) References Cited

U.S. PATENT DOCUMENTS

| | | | | | |
|---|---|---|---|---|---|
| 1,884,385 | A * | 10/1932 | Thordarson | 336/192 |
| 3,634,878 | A * | 1/1972 | Davis | 336/192 |
| 5,200,731 | A * | 4/1993 | Tochio et al. | 336/98 |
| 5,534,839 | A * | 7/1996 | Mackin et al. | 336/192 |
| 5,815,061 | A * | 9/1998 | Ho | 336/192 |
| 7,515,026 | B1 * | 4/2009 | Liu et al. | 336/192 |
| 7,633,367 | B2 * | 12/2009 | Chen et al. | 336/198 |
| 7,830,234 | B1 * | 11/2010 | Tien et al. | 336/208 |
| 7,886,425 | B2 * | 2/2011 | Liu et al. | 29/606 |
| 8,054,152 | B2 * | 11/2011 | Tseng et al. | 336/192 |
| 2011/0115594 | A1 * | 5/2011 | Yen | 336/192 |

* cited by examiner

*Primary Examiner* — Mohamad Musleh
*Assistant Examiner* — Joselito Baisa
(74) *Attorney, Agent, or Firm* — CKC & Partners Co., Ltd.

(57) ABSTRACT

A bobbin used in a transformer is disclosed. The bobbin includes a main body, two side walls, two wire collecting bases and at least one extension wire collecting base. The main body has a tunnel. The two side walls are disposed on the two ends of the main body, respectively. The tunnel passes through the two ends of the main body and the two side walls. The two wire collecting bases are disposed on the two side walls respectively or on one of the two side walls. Each wire collecting base has at least one wire collecting part. The extension wire collecting base has at least one extension wire collecting part. The extension wire collecting base can couple with the wire collecting base.

12 Claims, 5 Drawing Sheets

BOBBIN AND TRANSFORMER COMPRISING THE SAME

RELATED APPLICATIONS

This application claims priority to Taiwan Application Serial Number 100115877, filed May 6, 2011, which is herein incorporated by reference.

BACKGROUND

1. Field of Invention

The present invention relates to a bobbin structure, and more particularly to a bobbin with an extension wire collecting base and transformer comprising the same.

2. Description of Related Art

FIG. 1 illustrates a typical bobbin structure. The typical bobbin structure includes a main body 10, two side walls 12 and two wire collecting bases 14. The main body 10 has a tunnel. The two side walls 12 are disposed on the two ends of the main body 10, respectively. The two wire collecting bases 14 are disposed on the two side walls 12 respectively. The two side walls 12 limit the range of the wire surrounded in the main body 10.

However, the typical bobbin is formed by melt mold. That is, the number of pins formed on the wire collecting bases 14 is fixed. Therefore, when the number of pins is not enough to provide different voltage sources to a circuit, one resolving method is to re-design a bobbin that has a number of pins meeting the requirement of this circuit. However, it needs a lot of time and cost to re-design a bobbin. Another resolving method is to use a jumping wire technology to provide the voltage sources to the circuit. Although it is not necessary to re-design the bobbin structure in this method, additional manpower is necessary to arrange the location of the jumping wire.

Accordingly, a bobbin structure that can meet different requirements is reached.

SUMMARY

An object of the present invention is to provide a bobbin with an expandable wire collecting base. The extension wire collecting base can provide additional pins for a bobbin.

The present invention provides a bobbin used in a transformer. The bobbin includes a main body, two side walls, two wire collecting bases and at least one extension wire collecting base. The main body has a tunnel. The two side walls are disposed on the two ends of the main body, respectively. The tunnel passes through the two ends of the main body and the two side walls. The two wire collecting bases are disposed on the two side walls respectively or on one of the two side walls. Each wire collecting base has at least one wire collecting part. The extension wire collecting base has at least one extension wire collecting part. The extension wire collecting base can couple with the wire collecting base.

In an embodiment, the bobbin further comprises at least one first pin and at least one second pin. The first pin is disposed on the wire collecting part of the wire collecting base. The second pin is disposed on the extension wire collecting part of the extension wire collecting base.

In an embodiment, the wire collecting base has at least one first coupling structure and the extension wire collecting base has at least one second coupling structure. The first coupling structure can couple with the second coupling structure to make the extension wire collecting base couple with the wire collecting base.

The present invention also provides a transformer. The transformer includes a bobbin, at least one wire structure and a magnetic core. The bobbin includes a main body, two side walls, two wire collecting bases and at least one extension wire collecting base. The main body has a tunnel. The two side walls are disposed on the two ends of the main body, respectively. The tunnel passes through the two ends of the main body and the two side walls. The two wire collecting bases are disposed on the two side walls respectively or on one of the two side walls. Each wire collecting base has at least one wire collecting part. The extension wire collecting base has at least one extension wire collecting part. The extension wire collecting base can couple with the wire collecting base. The wire structure is disposed on the main body. The wire structure has a line terminal. The line terminal passes through the wire collecting part and the extension wire collecting part. The magnetic core is disposed on the tunnel of the bobbin.

In an embodiment, the bobbin further comprises at least one first pin and at least one second pin. The first pin is disposed on the wire collecting part of the wire collecting base. The second pin is disposed on the extension wire collecting part of the extension wire collecting base. The line terminal passes through the first pine, the wire collecting part and the extension wire collecting part to connect with the second pin.

In an embodiment, the wire collecting base has at least one first coupling structure and the extension wire collecting base has at least one second coupling structure. The first coupling structure can couple with the second coupling structure to make the extension wire collecting base couple with the wire collecting base.

Accordingly, an extension wire collecting base can couple with a wire collecting base of a bobbin of a transformer to provide additional pins. Therefore, it is not necessary for producer to re-design the bobbin structure. Moreover, the extension wire collecting base is independent from the wire collecting base. Therefore, the appearance and the number of pins of the extension wire collecting base are variable to meet different requirement of a circuit.

BRIEF DESCRIPTION OF THE DRAWINGS

In order to make the foregoing as well as other aspects, features, advantages, and embodiments of the present invention more apparent, the accompanying drawings are described as follows.

DETAILED DESCRIPTION

Figure 1:
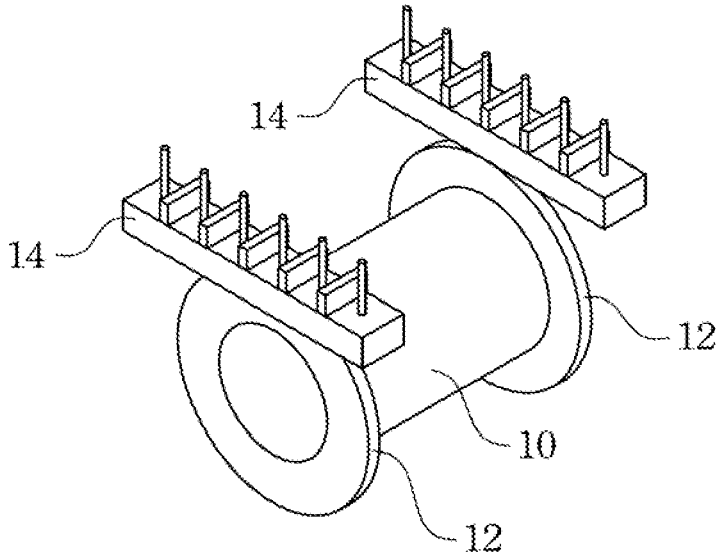
Fig. 1 (Prior Art)
FIG. 1 illustrates a typical bobbin structure.

Reference will now be made in detail to the present embodiments of the invention, examples of which are illustrated in the accompanying drawings. Wherever possible, the same reference numbers are used in the drawings and the description to refer to the same or like parts.

Figure 2:
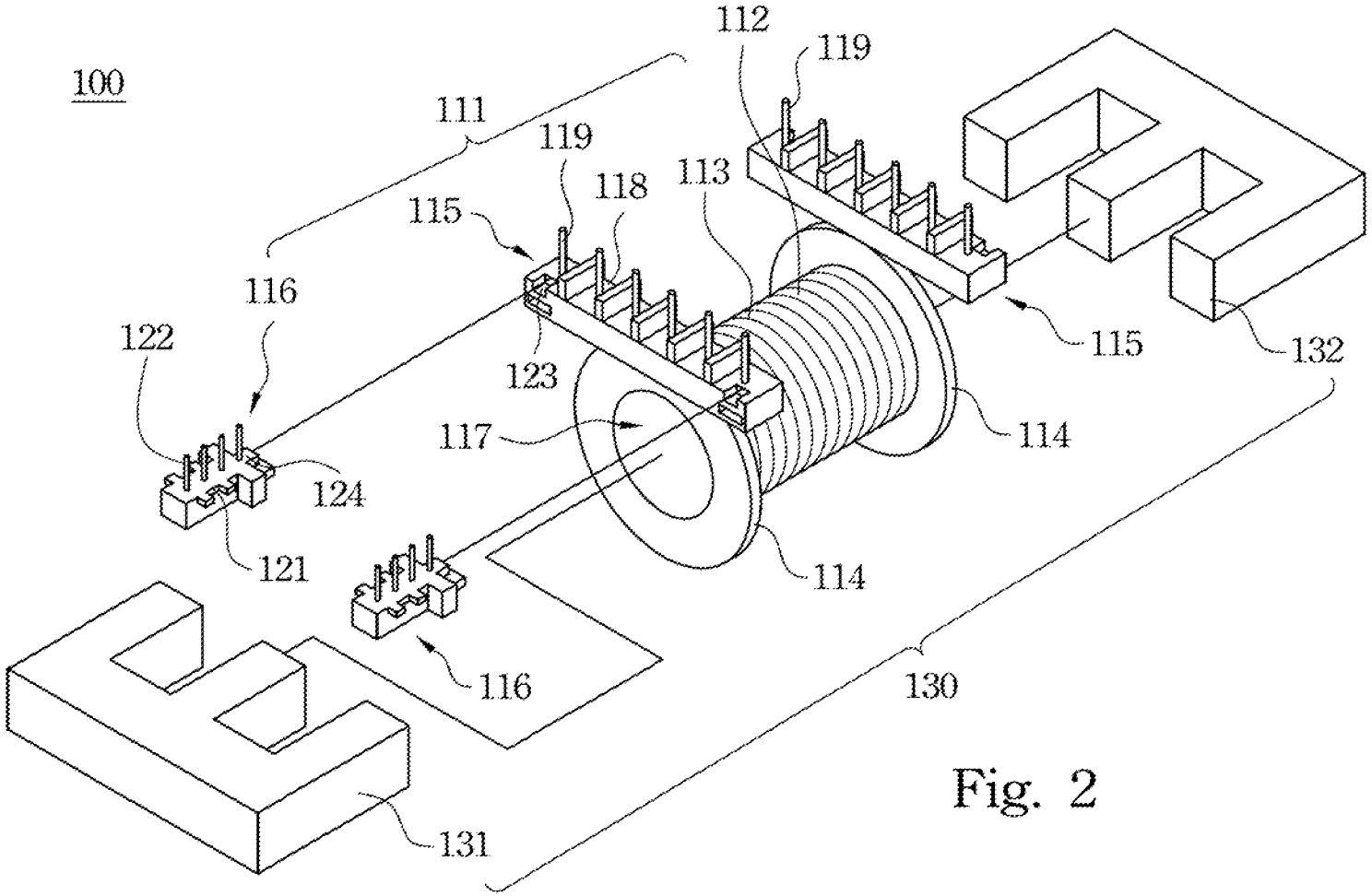
FIG. 2 illustrates an exploded diagram of a transformer according to a first embodiment of the present invention.

FIG. 2 illustrates an exploded diagram of a transformer according to a first embodiment of the present invention. The transformer 100 includes a bobbin 111, at least one wire structure 112 and a magnetic core 130. The bobbin 111 includes a main body 113, two side walls 114, two wire collecting bases 115 and two extension wire collecting bases 116. The main body 113 has a tunnel 117. The two side walls 114 are disposed on the two ends of the main body 113, respectively. The tunnel 117 passes through the two ends of the main body 113 and the two side walls 114. The two wire collecting bases 115 are disposed on the two side walls 114 respectively. Each wire collecting base 115 has a plurality of wire collecting parts 118. Pins 119 are disposed on the wire collecting part 118, respectively. Each extension wire collecting base 116 has a plurality of extension wire collecting parts 121. The extension wire collecting base 116 can couple with the wire collecting base 115. Pins 122 are disposed on the extension wire collecting part 121, respectively. Moreover, the wire collecting base 115 has two first coupling structures 123. The extension wire collecting base 116 has two second coupling structures 124. The appearance of the second coupling structure 124 corresponds to the appearance of the first coupling structure 123. Therefore, the second coupling structure 124 can couple with the first coupling structure 123 to make the extension wire collecting base 116 couple with the wire collecting base 115. In this embodiment, the first coupling structure 123 is only disposed on one of the two wire collecting bases 115. In another embodiment, the first coupling structure 123 are disposed on the two wire collecting bases 115 respectively to make both wire collecting bases 115 be able to couple the extension wire collecting base 116. In this embodiment, the first coupling structure 123 is a female connector and the second coupling structure 124 is a male connector. In another embodiment, the first coupling structure 123 is a male connector and the second coupling structure 124 is a female connector. The wire structure 112 is disposed on the main body 113 of the bobbin 111. Magnetic core 130 is composed of a first magnetic core 131 and a second magnetic core 132. Partial first magnetic core 131 and partial second magnetic core 132 are disposed in the tunnel 117.

Figure 3:
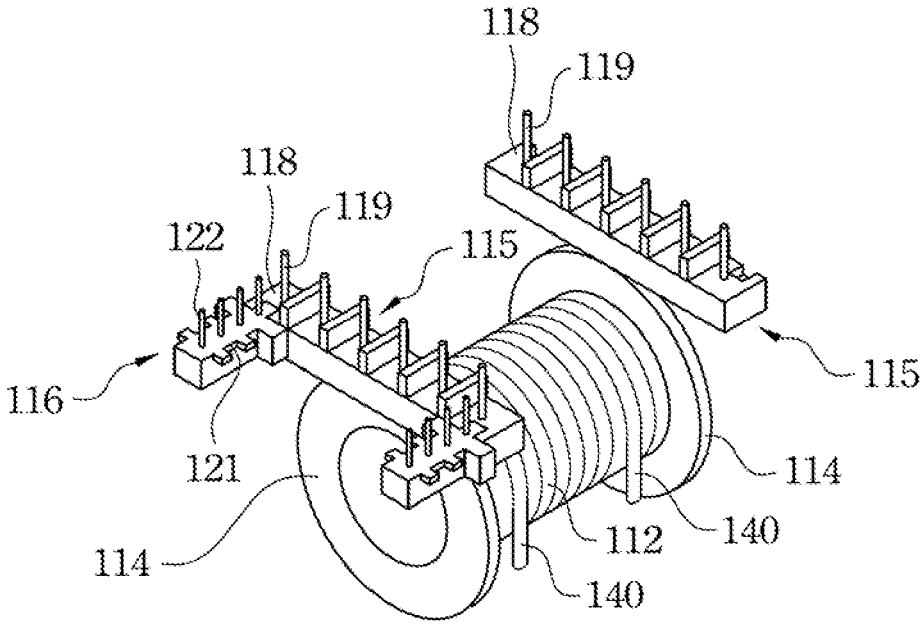
FIG. 3 illustrates a bobbin structure of the FIG. 2.

FIG. 3 illustrates a bobbin structure of the FIG. 2. The wire structure 112 has a line terminal 140. The line terminal 140 passes through the wire collecting part 118 of the wire collecting base 115 and the extension wire collecting part 121 of the extension wire collecting base 116 to connect the pins 122.

Figure 4:
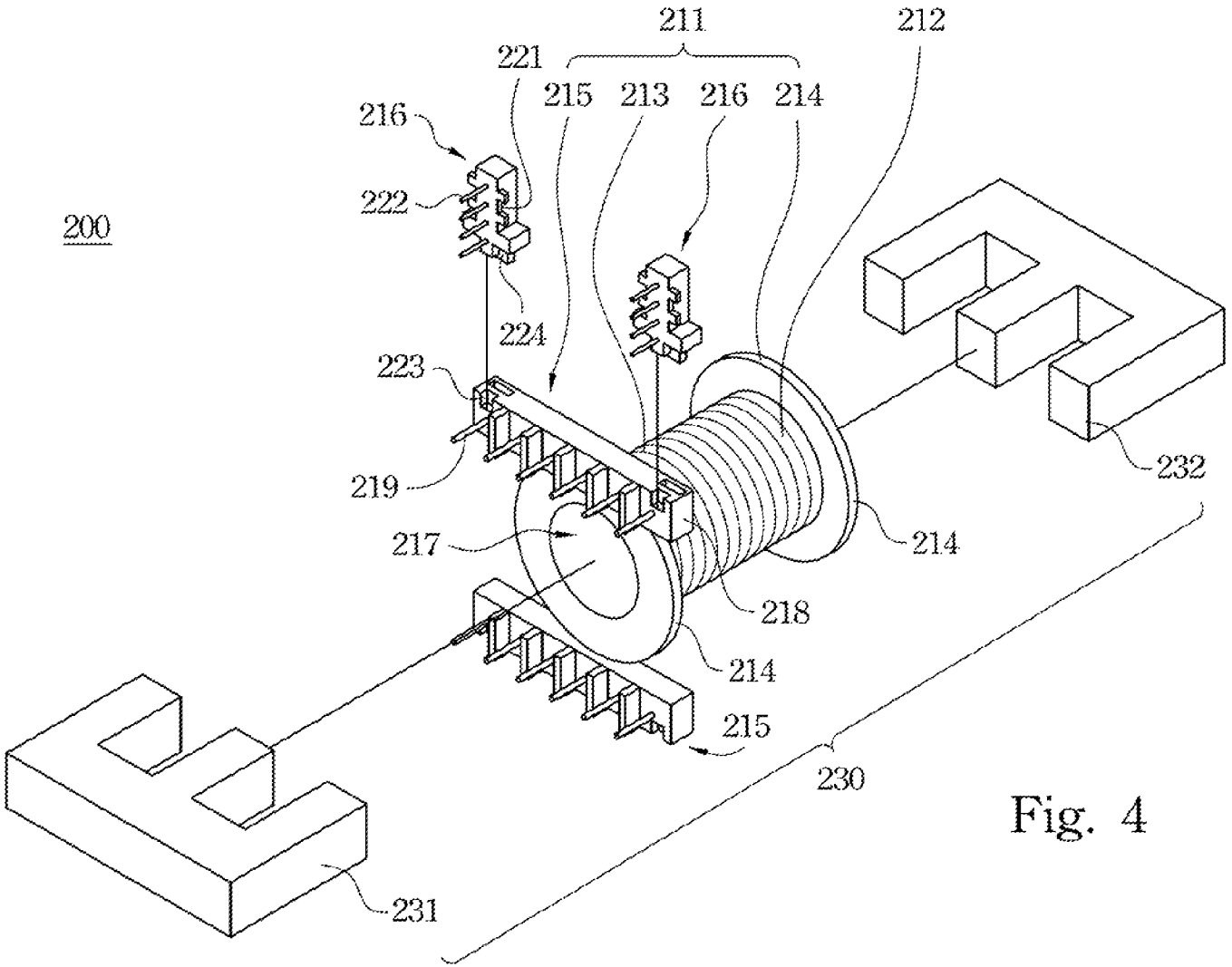
FIG. 4 illustrates an exploded diagram of a transformer according to a second embodiment of the present invention.

FIG. 4 illustrates an exploded diagram of a transformer according to a second embodiment of the present invention. The transformer 200 is an upright transformer. The transformer 200 includes a bobbin 211, at least one wire structure 212 and a magnetic core 230. The bobbin 211 includes a main body 213, two side walls 214, two wire collecting bases 215 and two extension wire collecting bases 216. The main body 213 has a tunnel 217. The two side walls 214 are disposed on the two ends of the main body 213, respectively, to limit the range of the wire structure 212. The tunnel 217 passes through the two ends of the main body 213 and the two side walls 214. The main different point between this embodiment and the first embodiment is that the two wire collecting bases 215 are disposed on one the two side walls 214. Each wire collecting base 215 has a plurality of wire collecting parts 218. Pins 219 are disposed on the wire collecting parts 218, respectively. Each extension wire collecting base 216 has a plurality of extension wire collecting parts 221. The extension wire collecting base 216 can couple with the wire collecting base 215. Pins 222 are disposed on the extension wire collecting parts 221, respectively. Moreover, the wire collecting base 215 has two first coupling structures 223. The extension wire collecting base 216 has two second coupling structures 224. The appearance of the second coupling structure 224 corresponds to the appearance of the first coupling structure 223. Therefore, the second coupling structure 224 can couple with the first coupling structure 223 to make the extension wire collecting base 216 couple with the wire collecting base 215. The wire structure 212 is disposed on the main body 213 of the bobbin 211. Magnetic core 230 is composed of a first magnetic core 231 and a second magnetic core 232. Partial first magnetic core 231 and partial second magnetic core 232 are disposed in the tunnel 217.

Figure 5:
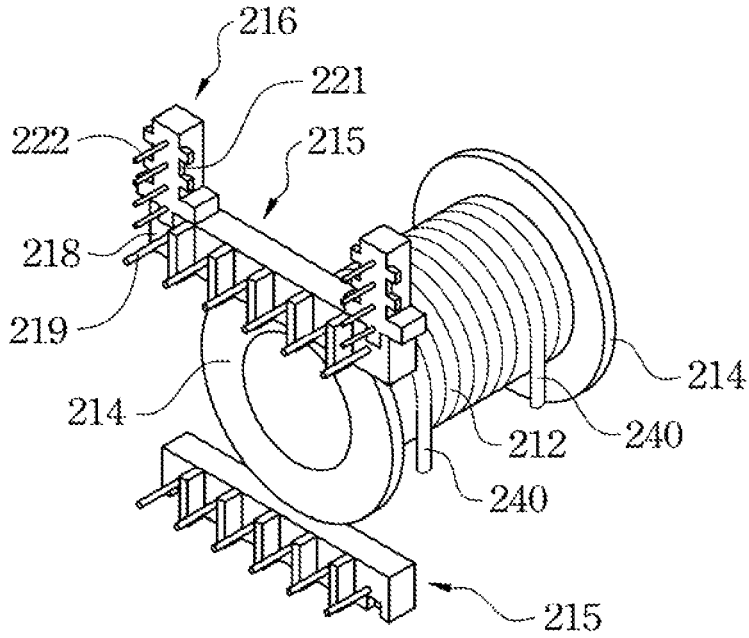
FIG. 5 illustrates a bobbin structure of the FIG. 4.

FIG. 5 illustrates a bobbin structure of the FIG. 4. The wire structure 212 has a line terminal 240. The line terminal 240 passes through the wire collecting part 218 of the wire collecting base 215 and the extension wire collecting part 221 of the extension wire collecting base 216 to connect the pins 222.

It is noticed that the extension wire collecting bases 116 and 216 expand from the wire collecting bases 115 and 215 along a special direction in the foregoing embodiments, respectively. However, in another embodiment, the extension wire collecting bases 116 and 216 expand from the wire collecting bases 115 and 215 along different directions, respectively, by changing the structure of the first coupling structures 123 and 223 and the second coupling structure 124 and 224. That is, the included angle between the extension wire collecting bases 116 and the side wall 114 or between the extension wire collecting bases 216 and the side wall 214 is variable to meet the requirement of the circuit.

On the other hand, two extension wire collecting bases are disposed in the transformer to provide additional pins for connecting circuit in the foregoing embodiments. However, in another embodiment, any number of the extension wire collecting base can be disposed in a transformer to meet the pins requirement of a circuit. That is, a user can couple any number of the extension wire collecting bases to the wire collecting bases as long as the number of the first coupling structures formed in the wire collecting bases are enough. On the other hand, in practice, extension wire collecting bases with different number of pins are manufactured first. Then, a user can couple extension wire collecting base with desired number of pins to wire collecting base to meet the requirement of a circuit. Moreover, the extension wire collecting base has a strip appearance in foregoing embodiments. However, in another embodiment, the appearance of the extension wire collecting base is variable based on the circuit design.

Accordingly, according to the present invention, when a number of pins in a bobbin is not enough, an extension wire collecting base can couple with a wire collecting base of the bobbin to provide additional pins. Therefore, it is not necessary for producer to re-design the bobbin structure, which can reduce the manufacturing cost. On the other hand, only the extension wire collecting base has to be re-designed to meet the number of pins required by a circuit. Therefore, the manufacturing yield of bobbin is increased. Moreover, the extension wire collecting base is independent from the wire collecting base. Therefore, the appearance and the number of pins of the extension wire collecting base is variable to meet different requirements of a circuit.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A bobbin, wherein the bobbin is disposed in a transformer, comprising:

a main body, wherein the main body has a tunnel;

two side walls, wherein the two side walls are disposed on two ends of the main body respectively, and the tunnel passes through the two ends of the main body and the two side walls;

two wire collecting bases, wherein the two wire collecting bases are disposed on the two side walls respectively, and each wire collecting base has at least one wire collecting part; and at least one extension wire collecting base, wherein the extension wire collecting base has at least one extension wire collecting part and the extension wire collecting base can couple with the wire collecting base.

2. The bobbin of claim 1, wherein the bobbin further comprises at least one first pin and at least one second pin, the first pin is disposed on the wire collecting part of the wire collecting base and the second pin is disposed on the extension wire collecting part of the extension wire collecting base.

3. The bobbin of claim 1, wherein the wire collecting base has at least one first coupling structure and the extension wire collecting base has at least one second coupling structure, the first coupling structure can couple with the second coupling structure to make the extension wire collecting base couple with the wire collecting base.

4. A bobbin, wherein the bobbin is disposed in a transformer, comprising:

a main body, wherein the main body has a tunnel;

two side walls, wherein the two side walls are disposed on two ends of the main body respectively, and the tunnel passes through the two ends of the main body and the two side walls;

two wire collecting bases, wherein the two wire collecting bases are disposed on one of the two side walls, and each wire collecting base has at least one wire collecting part; and at least one extension wire collecting base, wherein the extension wire collecting base has at least one extension wire collecting part and the extension wire collecting base can couple with the wire collecting base.

5. The bobbin of claim 4, wherein the bobbin further comprises at least one first pin and at least one second pin, the first pin is disposed on the wire collecting part of the wire collecting base and the second pin is disposed on the extension wire collecting part of the extension wire collecting base.

6. The bobbin of claim 4, wherein the wire collecting base has at least one first coupling structure and the extension wire collecting base has at least one second coupling structure, the first coupling structure can couple with the second coupling structure to make the extension wire collecting base couple with the wire collecting base.

7. A transformer, comprising:

a bobbin, wherein the bobbin comprises:

a main body, wherein the main body has a tunnel;

two side walls, wherein the two side walls are disposed on two ends of the main body respectively, and the tunnel passes through the two ends of the main body and the two side walls;

two wire collecting bases, wherein the two wire collecting bases are disposed on the two side walls respectively, and each wire collecting base has at least one wire collecting part; and at least one extension wire collecting base, wherein the extension wire collecting base has at least one extension wire collecting part and the extension wire collecting base can couple with the wire collecting base;

at least one wire structure, wherein the wire structure is disposed on the main body, the wire structure has a line terminal, the line terminal passes through the wire collecting part and the extension wire collecting part; and a magnetic core, wherein partial magnetic core is disposed on the tunnel.

8. The transformer of claim 7, wherein the bobbin further comprises at least one first pin and at least one second pin, the first pin is disposed on the wire collecting part of the wire collecting base and the second pin is disposed on the extension wire collecting part of the extension wire collecting base, wherein the line terminal passes through the first pine and the extension wire collecting part to connect with the second pin.

9. The transformer of claim 7, wherein the wire collecting base has at least one first coupling structure and the extension wire collecting base has at least one second coupling structure, the first coupling structure can couple with the second coupling structure to make the extension wire collecting base couple with the wire collecting base.

10. A transformer, comprising:

a bobbin, wherein the bobbin comprises:

a main body, wherein the main body has a tunnel;

two side walls, wherein the two side walls are disposed on two ends of the main body respectively, and the tunnel passes through the two ends of the main body and the two side walls;

two wire collecting bases, wherein the two wire collecting bases are disposed on one of the two side walls, and each wire collecting base has at least one wire collecting part; and at least one extension wire collecting base, wherein the extension wire collecting base has at least one extension wire collecting part and the extension wire collecting base can couple with the wire collecting base;

at least one wire structure, wherein the wire structure is disposed on the main body, the wire structure has a line terminal, the line terminal passes through the wire collecting part and the extension wire collecting part; and a magnetic core, wherein partial magnetic core is disposed on the tunnel.

11. The transformer of claim 10, wherein the bobbin further comprises at least one first pin and at least one second pin, the first pin is disposed on the wire collecting part of the wire collecting base and the second pin is disposed on the extension wire collecting part of the extension wire collecting base, wherein the line terminal passes through the first pine and the extension wire collecting part to connect with the second pin.

12. The transformer of claim 10, wherein the wire collecting base has at least one first coupling structure and the extension wire collecting base has at least one second coupling structure, the first coupling structure can couple with the second coupling structure to make the extension wire collecting base couple with the wire collecting base.

* * * * *